United States Patent [19]

Howard et al.

[11] Patent Number: 4,734,115

[45] Date of Patent: Mar. 29, 1988

[54] LOW PRESSURE PROCESS FOR $C_3$+ LIQUIDS RECOVERY FROM PROCESS PRODUCT GAS

[75] Inventors: Lee J. Howard, Emmaus; Howard C. Rowles, Center Valley, both of Pa.

[73] Assignee: Air Products and Chemicals, Inc., Allentown, Pa.

[21] Appl. No.: 843,322

[22] Filed: Mar. 24, 1986

[51] Int. Cl.[4] ..... F25J 1/02

[52] U.S. Cl. ..... 62/40; 62/28; 62/44; 62/112

[58] Field of Search ..... 62/11, 23, 24, 27, 28, 62/40, 41, 42, 44, 112, 476

[56] References Cited

U.S. PATENT DOCUMENTS

| | | | |
|---|---|---|---|
| 3,349,571 | 10/1967 | Nebgen | 62/41 X |
| 3,817,046 | 6/1974 | Aoki et al. | 62/40 |
| 3,878,689 | 4/1975 | Grenci | 62/42 X |
| 4,043,770 | 8/1977 | Jakob | 62/23 X |
| 4,283,918 | 8/1981 | Mehta | 62/112 |
| 4,350,571 | 9/1982 | Erickson | 62/40 X |
| 4,381,418 | 4/1983 | Gewartowski et al. | 585/655 |
| 4,519,825 | 5/1985 | Bernhard et al. | 62/28 |

OTHER PUBLICATIONS

Gussow et al, "Dehydrogenation Links LPG to More Octanes", Oil & Gas Journal, Dec. 1980, pp. 96–101.

*Petroleum Refining*, J. H. Gary & G. E. Handwork, ©1984, pp. 208–210.

*Primary Examiner*—Steven E. Warner

*Attorney, Agent, or Firm*—Willard Jones, II; James C. Simmons; William F. Marsh

[57] ABSTRACT

The invention provides a liquids recovery process useful for the separation and recovery of $C_3$+ liquid hydrocarbons from gas mixtures containing high concentrations of lighter components such as are produced by the dehydrogenation of liquefied petroleum gases or by the catalytic cracking of heavy oils. The recovery process employs an absorption refrigeration cycle to supply high level refrigeration to the process; the absorption cycle utilizes low pressure steam or a heated fluid derived from secondary heat recovery of a process flue gas to effect heating in the absorption refrigeration cycle.

13 Claims, 3 Drawing Figures

HIGH PRESSURE RECOVERY

LOW PRESSURE RECOVERY

LOW PRESSURE PROCESS FOR $C_3$+ LIQUIDS RECOVERY FROM PROCESS PRODUCT GAS

TECHNICAL FIELD

This invention relates to a process for the separation and recovery of $C_3$, $C_4$ and/or $C_5$ liquid hydrocarbons (i.e. $C_3$+) from gas mixtures containing high concentrations of lighter components such as are produced by dehydrogenation of liquefied petroleum gas, i.e. propane, normal butane, isobutane, isopentane or mixtures thereof or by the catalytic cracking of heavy oils.

BACKGROUND OF THE INVENTION

Several processes have been used commercially and have been proposed to separate and recover $C_3$+ hydrocarbons from dehydrogenation or catalytic cracking off-gas mixtures.

In an article by S. Gussow, et al., "Dehydrogenation Links LPG to More Octanes", *Oil and Gas Journal,* December 1980, pages 96 through 101 an absorption-stripping process is disclosed. In this process $C_3$ through $C_5$ hydrocarbons are absorbed into an oil along with lesser quantities of lighter components. The $C_3$+ hydrocarbons and dissolved light impurities are then stripped from the oil in a reboiled stripping column and condensed in an overhead condenser. This process is characterized by high energy requirements, particularly to supply the fired reboiler heat. In addition, large, expensive columns and associated heat exchangers and a large fired heater are required due to the high oil circulation rate necessary for high product recovery, typically, in the 98 to 99.8 percent range.

A similar absorption-stripping process is widely used for recovery of $C_3$–$C_4$ hydrocarbons from catalytic cracking unit off-gas. This process is described by J. H. Gary and G. E. Handwork in *Petroleum Refining,* 2nd Edition, 1984, pages 208 through 210.

In U.S. Pat. No. 4,381,418. another separation process is disclosed. In this process, a dehydrogenation process off-gas mixture is compressed and cooled to a sufficiently low temperature to condense the desired heavy hydrocarbon components along with some light impurities. Refrigeration for the process is provided primarily by cooling of the liquid hydrocarbon feedstock and subsequent mixing with recycled hydrogen, followed by revaporization of the hydrogen/hydrocarbon mixture. The high hydrogen concentration of the mixture reduces the partial pressure of the vaporizing hydrocarbons sufficiently to provide refrigeration at the required temperature levels for high product recovery, e.g. −10° F. to −50° F. for $C_4$ recovery. This process requires that the feedstock hydrocarbon be dried to avoid freezing at the cold vaporization temperatures. It also requires high hydrogen recycle rates in the dehydrogenation process to achieve the low hydrocarbon partial pressures required for feedstock revaporization at suitable low temperature levels.

In U.S. Pat. No. 4,519,825, a third recovery process is disclosed. In this process, the product gas mixture is compressed, cooled and partially rectified in a dephlegmator to separate the desired heavier hydrocarbons from the bulk of the light impurities. The light gases are expanded to provide refrigeration for the process. With typical $C_4$ dehydrogenation off-gases, this process requires no low level, i.e. below 20° F., auxiliary refrigeration, but requires that the off-gas be compressed to a relatively high pressure, e.g. in the range of 350 to 550 psia, in order to provide sufficient expansion refrigeration for high product liquids recovery, e.g. 98 to 99.8+ percent. A large fraction of the $C_4$+ hydrocarbons, e.g. more than half, is typically condensed via cooling water or air cooling in the compressor aftercooler. A small quantity of high level refrigeration, i.e. 35°–65° F., is necessary if the off-gas is further precooled prior to drying. With a typical lean refinery gas, this process requires that the gas be compressed to 225 psia in order to provide sufficient expansion refrigeration for high $C_4$+ liquids recovery, e.g. 98.5 percent.

In all of the prior art processes described above, downstream fractionation of the recovered $C_3$ to $C_5$ hydrocarbons is usually necessary to achieve the desired product purity levels or to separate unreacted feedstock hydrocarbons for recycle or other use.

Several processes have been disclosed which utilize an absorption heat pump refrigeration cycle to provide refrigeration to separation and liquefaction processes.

In U.S. Pat. No. 4,350,571 a process and apparatus for reducing the amount of energy which must be supplied to thermally activated separation processes such as fractional distillation, distillation, dehydration or acid gas scrubbing is disclosed. The reduction is accomplished by incorporating an absorption heat pump into the process such that the absorption heat pump accepts rejected heat from, i.e. provides cooling to, the process and supplies high temperature heat back to the process. The absorption heat pump causes the necessary temperature increase through the motive power of an external heat source applied to it, in contrast to the mechanical power source required by conventional heat pumps.

In U.S. Pat. No. 3,817,046, a combination cooling process which is particularly useful for the liquefaction of natural gas is disclosed. The process employs a multi-component cooling cycle coupled to an absorption refrigeration cycle, and utilizes the waste exhaust energy from a driver for compressors in the multi-component cycle to effect heating in the absorption refrigeration cycle.

BRIEF SUMMARY OF THE INVENTION

The present invention is a process for the separation and recovery of $C_3$+ liquid hydrocarbons from a dehydrogenation, catalytic cracking or similar process product stream having high concentrations of lighter components, which comprises the steps of: compressing said process product stream, unless already compressed to a pressure of 75 psia or greater; cooling said compressed product stream thereby condensing a first portion of the $C_3$+ hydrocarbons in the product stream; separating out the first portion of condensed $C_3$+ hydrocarbons from the product stream; further cooling the remaining product stream by heat exchange with a circulating refrigerant produced by an absorption refrigeration cycle which utilizes recovered heat, thereby condensing a second portion of the $C_3$+ hydrocarbons in the product stream; separating out the second portion of condensed $C_3$+ hydrocarbons from the product stream; drying the remaining product stream in a drier to remove any impurities which would freeze out in a low temperature recovery unit; and feeding the dried remaining product stream to a low temperature recovery unit thereby cooling the dried remaining product stream, condensing at least a portion of any remaining $C_3$+ hydrocarbons, separating out and removing said portion of said $C_3$+ hydrocarbons, and removing a waste stream consisting essentially of lighter components.

DETAILED DESCRIPTION OF THE INVENTION

Prior to discussion of the present invention, it is necessary to examine two standard liquids recovery sections utilized in the art for high recovery of liquids from dehydrogenation product gas. These two liquids recovery sections both use mechanical means, in addition to expansion of a waste stream, to generate the refrigeration necessary for the liquids recovery and differ only in the operating pressure of the recovery section.

Figure 1:
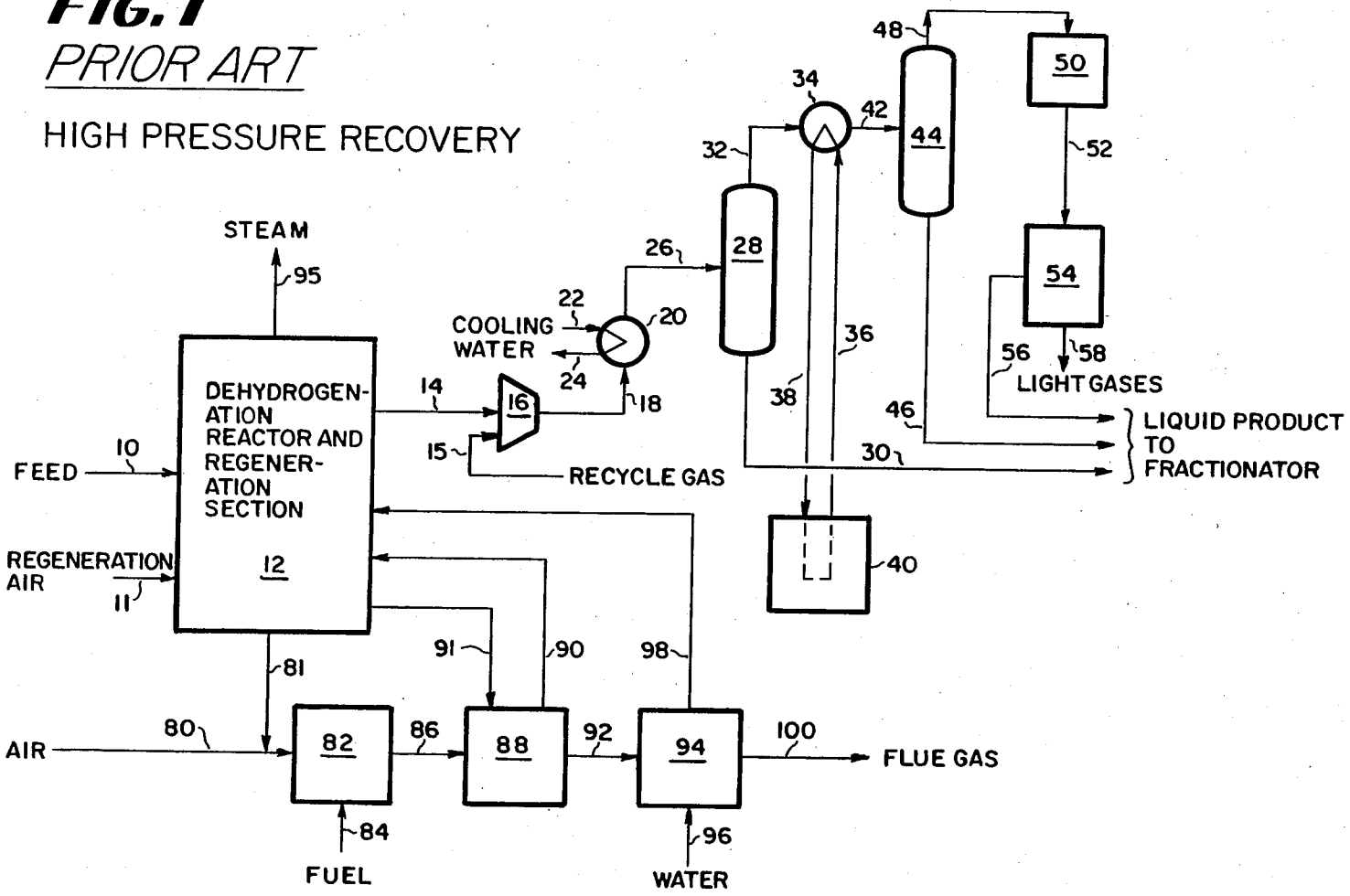
FIG. 1 PRIOR ART
FIG. 1 is a schematic of a dehydrogenation process unit with a high pressure liquids recovery section utilizing a mechanical refrigeration cycle for high level refrigeration duty.

With reference to FIG. 1 the reactor and regeneration, compression, liquids recovery and heat recovery sections of a typical dehydrogenation process with a high pressure liquids recovery section are shown. In the process, LPG feed, via line 10, and regeneration air, via line 11, are fed to the dehydrogenation reactor and regeneration section 12. Any dehydrogenation reactor and regeneration system can be utilized in the present invention. Reactor product, line 14, and recycle gas from the fractionation system (not shown in drawing), line 15, are compressed in compressor 16 to a pressure of about 350 to 550 psia. Effluent from compressor 16 is passed to heat exchanger 20, via line 18, where it is cooled to about 80° F. to 120° F., thereby condensing a large portion of the $C_3+$ hydrocarbons in the stream. The cooling duty for heat exchanger 20 is typically provided by cooling water which enters the heat exchanger via line 22 and is removed via line 24. This cooled, compressed stream is fed, via line 26, to separator 28 where any condensed hydrocarbons in the compressed stream are removed via line 30. The overhead of separator 28, in line 32, is further cooled to about 40° F. to 70° F. in heat exchanger 34 by means of a flowing heat exchange medium, e.g. chilled water or brine solution, produced in mechanical refrigeration unit 40. The heat exchange medium is circulated to the heat exchanger via line 36 and returned to mechanical refrigeration unit 40, via line 38. As a result of this cooling, a small fraction of the $C_3+$ hydrocarbons in overhead stream 32 is condensed resulting in a relatively low refrigeration requirement for the unit 40. This cooled overhead stream is fed, via line 42, to separator 44 and the condensed hydrocarbons are removed via line 46. The overhead from separator 44 is fed, via line 48, to drier 50 for removal of impurities which would freeze out at the operating conditions of the low temperature recovery unit and is fed from drier 50, via line 52, to low temperature recovery unit 54 which separates most of the remaining $C_3+$ hydrocarbons from the lighter impurities (i.e. the waste stream). Low temperature recovery unit 54 may be a dephlegmator-type such as is described in U.S. Pat. No. 4,519,825 or any other suitable type. The $C_3+$ hydrocarbons are removed via line 56 and the lighter impurities are removed via line 58.

The light gas impurities stream 58 from low temperature recovery unit 54, at a pressure of about 50 to 125 psia, is typically sent to the facility fuel system. An expander (not shown) is typically utilized to recover any available refrigeration from the pressure letdown of the light gas stream from the feed pressure to fuel pressure.

The recovered hydrocarbon liquid streams 30, 46, and 56 are sent to the product fractionation section which is not shown for removal of residual light impurities such as hydrogen, nitrogen, carbon monoxide, carbon dioxide and light hydrocarbons and for separation and purification of the $C_3+$ hydrocarbons; In the fractionation system the $C_3+$ hydrocarbons are separated to recover the desired products, e.g. isobutene. The unreacted feedstock, e.g. isobutane, and other heavy hydrocarbons are typically recycled back to the reactor section.

In the heat recovery section of the process, regeneration effluent gas, via line 81, is mixed with additional combustion air, via line 80, and with fuel, via line 84, and is incinerated in heater 82, resulting in a flue gas stream 86 at a temperature of about 1350° F. The flue gas, stream 86, is cooled to near 400° F. via conventional high level waste heat recovery steps; i.e. waste heat reboiler 88 to generate high pressure steam for use in the process, the high temperature steam entering the process via line 90 and returning to the reboiler via line 91, and boiler feedwater preheater 94. Boiler feedwater, via line 96, is heated in preheater 94 with the flue gas in line 92; heated boiler feedwater from preheater 94 is sent, via line 98, to reactor and regeneration section 12, and additional high pressure steam is produced there. Most of the high pressure steam, line 95, is normally utilized to drive reactor product and air compressors. The flue gas from heat recovery unit 94 is vented to the atmosphere, via line 100.

Figure 2:
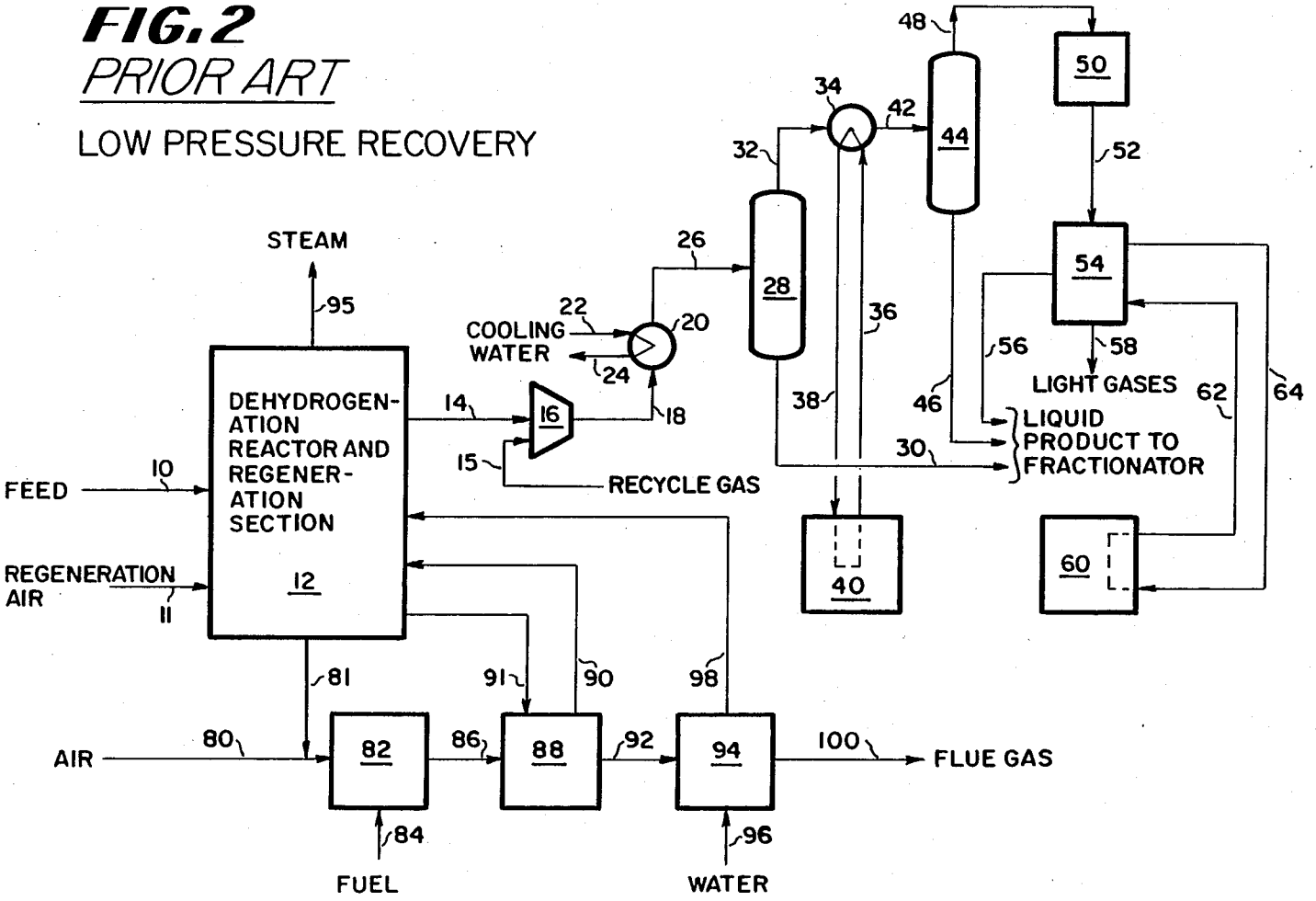
FIG. 2 PRIOR ART
FIG. 2 is a schematic of a dehydrogenation process unit with a low pressure liquids recovery system utilizing two mechanical refrigeration cycles for providing low level and high level refrigeration to the recovery process.

With reference to FIG. 2 the reactor and regeneration, compression, liquids recovery and heat recovery sections of a typical dehydrogenation process with a low pressure liquids recovery section are shown. In the process, LPG feed, via line 10, and regeneration air, via line 11, are fed to the dehydrogenation reactor and regeneration section 12. Any dehydrogenation reactor and regeneration system can be utilized in the present invention. Reactor product, line 14, and recycle gas from the fractionation system (not shown in drawing), line 15, are compressed in compressor 16 to a pressure of about 75 to 250 psia. Effluent from compressor 16 is passed to heat exchanger 20, via line 18, where it is cooled to about 80° F. to 120° F., thereby condensing a portion of the $C_3+$ hydrocarbons in the stream. The cooling duty for heat exchanger 20 is typically provided by cooling water which enters the heat exchanger via line 22 and is removed via line 24. This cooled, compressed stream is fed, via line 26, to separator 28 where any condensed hydrocarbons in the compressed stream are removed via line 30. The overhead, line 32, of separator 28 is further cooled to about 35° F. to 65° F. in heat exchanger 34 by means of a flowing heat exchange medium, e.g. freon, propane, chilled water or brine solution, produced in mechanical refrigeration unit 40.

The heat exchange medium is circulated to the heat exchanger via line 36 and returned to mechanical refrigeration unit 40, via line 38. As a result of this cooling, a large fraction of the $C_3+$ hydrocarbons in overhead stream 32 is condensed resulting in a relatively high refrigeration requirement for the unit. This cooled overhead stream is fed, via line 42, to separator 44 and the condensed hydrocarbons are removed via line 46. The overhead from separator 44 is fed, via line 48, to drier 50 for removal of impurities which would freeze out at the operating conditions of the low temperature recovery unit and is fed from drier 50, via line 52, to low temperature recovery unit 54 which separates most of the remaining $C_3+$ hydrocarbons from the lighter impurities. Low temperature recovery unit 54 may be a dephlegmator-type such as is described in U.S. Pat. No. 4,519,825 or any other suitable type. The $C_3+$ hydrocarbons are removed via line 56 and the lighter impurities are removed via line 58.

The light gas impurities stream 58 from low temperature recovery unit 54, at a pressure of about 50 to 125 psia, is typically sent to the facility fuel system. An expander (not shown) is typically utilized to recover any available refrigeration from the pressure letdown of the light gas stream from the feed pressure to fuel pressure. A low level refrigeration unit producing refrigeration below 20° F. is required to augment refrigeration produced by expansion in the low temperature recovery unit to achieve high product liquids recovery. This unit would typically be a conventional mechanical refrigeration unit, such as refrigeration unit 60, utilizing vapor compression of a suitable refrigerant such as propane, propene, ammonia or freon. The refrigerant flows from refrigeration unit 60, via line 62, to low temperature recovery unit 54 and returns to refrigeration unit 60, via line 64.

The recovered hydrocarbon liquid streams 30, 46, and 56 are sent to the product fractionation section which is not shown for removal of residual light impurities such as hydrogen, nitrogen, carbon monoxide, carbon dioxide and light hydrocarbons and for separation and purification of the $C_3+$ hydrocarbons. In the fractionation system the $C_3+$ hydrocarbons are separated to recover the desired products, e.g. isobutene. The unreacted feedstock, e.g. isobutane, and other heavy hydrocarbons are typically recycled back to the reactor section.

In the heat recovery section of the process, regeneration effluent gas, via line 81, is mixed with additional combustion air, via line 80, and with fuel, via line 84, and is incinerated in heater 82, resulting in a flue gas stream 86 at a temperature of about 1350° F. The flue gas, stream 86, is cooled to near 400° F. via conventional high level waste heat recovery steps; i.e. waste heat reboiler 88 to generate high pressure steam for use in the process, the high temperature steam entering the process via line 90 and returning to the reboiler via line 91, and boiler feedwater preheater 94. Boiler feedwater, via line 96, is heated in preheater 94 with the flue gas in line 92; heated boiler feedwater from preheater 94 is sent, via line 98, to reactor and regeneration section 12, and additional high pressure steam is produced there. Most of the high pressure steam, line 95, is normally utilized to drive reactor product and air compressors. The flue gas from heat recovery unit 94 is vented to the atmosphere, via line 100.

The liquids recovery section of the present invention is similar to the low pressure recovery section discussed previously, however, the present invention takes advantage of the energy available in flue gas stream 100 and utilizes it in an absorption refrigeration unit. This absorption refrigeration unit replaces mechanical refrigeration unit 40 and provides the refrigeration required in heat exchanger 34. A more detailed description follows.

Figure 3:
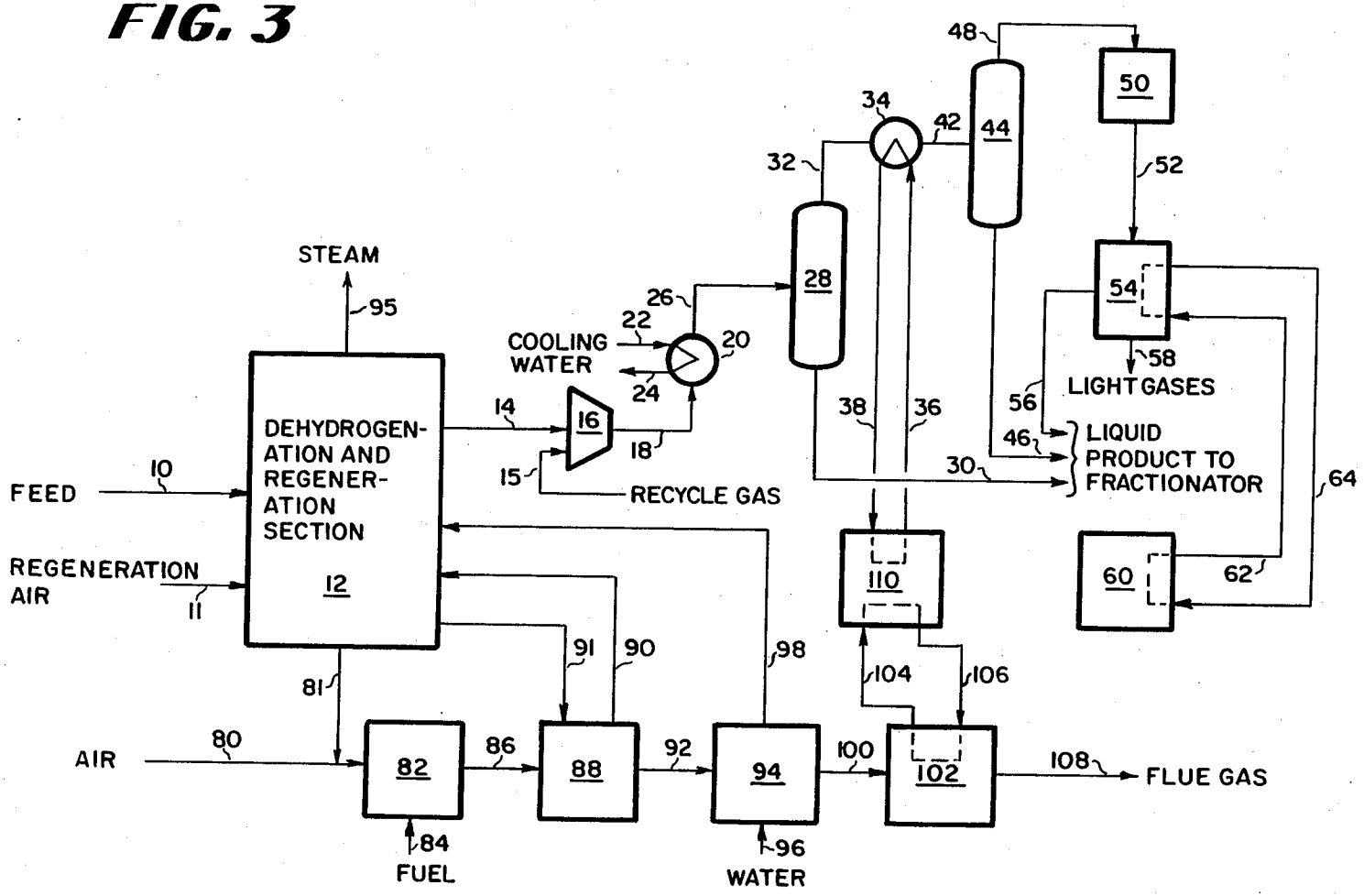
FIG. 3 is a schematic of a dehydrogenation process unit with a low pressure liquids recovery system which utilizes a mechanical refrigeration cycle for provision of low level refrigeration, however, the process utilizes an absorption refrigeration cycle for provision of high level refrigeration to the recovery process.

With reference to FIG. 3 the reactor and regeneration, compression, liquids recovery and heat recovery sections of a typical dehydrogenation process with the liquids recovery section of the present invention are shown. In the process, LPG feed, via line 10, and regeneration air, via line 11, are fed to the dehydrogenation reactor and regeneration section 12. Any dehydrogenation reactor and regeneration system can be utilized in the present invention. Reactor product, line 14, and recycle gas from the fractionation system (not shown in drawing), line 15, are fed to and compressed in compressor 16 to a pressure of about 75 to 250 psia, followed by cooling to about 80° F. to 120° F. in heat exchanger 20, thereby condensing a portion of the $C_3+$ hydrocarbons in the stream. The cooling duty for heat exchanger 20 is typically provided by cooling water which enters the heat exchanger via line 22 and is removed via line 24. This cooled, compressed stream is fed, via line 26, to separator 28 where any condensed hydrocarbons in the compressed stream are removed via line 30. The overhead, line 32, of separator 28 is further cooled to about 35° F. to 65° F. in heat exchanger 34 by means of a flowing heat exchange medium produced in absorption refrigeration unit 110. The heat exchange medium is circulated to the heat exchanger via line 36 and returned to absorption refrigeration unit 110, via line 38. As a result of this cooling, a large fraction of the $C_3+$ hydrocarbons in overhead stream 32 is condensed resulting in a relatively high refrigeration requirement for the unit. This cooled overhead stream is fed, via line 42, to separator 44 and the condensed hydrocarbons are removed via line 46. The overhead of separator 44 is fed, via line 48, to drier 50 for removal of impurities which would freeze out at the operating conditions of the low temperature recovery unit and is fed from drier 50, via line 52, to low temperature recovery unit 54 which separates most of the remaining $C_3+$ hydrocarbons from lighter impurities. Low temperature recovery unit 54 may be a dephlegmator-type such as is described in U.S. Pat. No. 4,519,825 or any other suitable type. The $C_3+$ hydrocarbons are removed via line 56 and the lighter impurities are removed via line 58.

The light gas impurities stream 58 from low temperature recovery unit 54, at a pressure of about 50 to 125 psia, is typically sent to the facility fuel system. An expander (not shown) is typically utilized to recover any available refrigeration from the pressure letdown of the light gas stream from the feed pressure to fuel pressure. A low level refrigeration unit producing refrigeration below 20° F. is typically required to augment refrigeration produced by expansion in the low temperature recovery unit to achieve high product liquids recovery. This unit would typically be a conventional mechanical refrigeration unit, such as refrigeration unit 60, utilizing vapor compression of a suitable refrigerant such as propane, propene, ammonia or freon. The refrigerant flows from refrigeration unit 60, via line 62, to low temperature recovery unit 54 and returns to refrigeration unit 60, via line 64. However, any other suitable means to produce the required low level refrigeration may be utilized.

The recovered hydrocarbon liquid streams 30, 46, and 56 are sent to the product fractionation section which is not shown for removal of residual light impurities such as hydrogen, nitrogen, carbon monoxide, carbon dioxide and light hydrocarbons and for separation and purification of the $C_3+$ hydrocarbons. In the fractionation system the $C_3+$ hydrocarbons are separated to recover the desired products, e.g. isobutene. The unreacted feedstock, e.g. isobutane, and other heavy hydrocarbons are typically recycled back to the reactor section.

In the heat recovery section of the process, regeneration effluent gas, via line 81, is mixed with additional air, via line 80, and with fuel, via line 84, and is incinerated in heater 82, resulting in a flue gas stream 86 at a temperature of about 1350° F. The flue gas, stream 86, is cooled to near 400° F. via conventional high level waste heat recovery steps; i.e. waste heat reboiler 88 to generate high pressure steam for use in the process, the high temperature steam entering the process via line 90 and returning to the reboiler via line 91, and boiler feedwater preheater 94. Boiler feedwater, via line 96, is heated in preheater 94 with the flue gas in line 92; heated boiler feedwater from preheater 94 is sent, via line 98, to reactor and regeneration section 12, and additional high pressure steam is produced there. Most of the high pressure steam, line 95, is normally utilized to drive reactor product and air compressors. The flue gas stream 100 from heat recovery unit 94 is further cooled in low pressure steam boiler 102. This low level heat recovery step produces low pressure steam, about 25 psia, which is fed via line 104 to absorption refrigeration unit 110. This low pressure steam is condensed to drive adsorption refrigeration unit 110 and the condensate is returned to boiler 102 via line 106 for revaporization. The low level heat available from flue gas stream 100 is usually sufficient to produce enough low pressure steam to drive an absorption refrigeration unit large enough to supply all of the high level refrigeration required for precooling and condensing of a large portion of stream 32.

Alternatively, high pressure condensate heated to about 225° F. to 275° F. in the low level heat recovery unit 102 can be used to supply heat to the absorption refrigeration unit in place of the low pressure steam. Other fluids are also suitable.

The adsorption refrigeration unit of the present invention may be any type, e.g. a water-aqueous lithium bromide type described in an article by R. P. Leach and A. Rajguru, "Design for Free Chilling", *Hydrocarbon Processing*, August 1984, pages 80–81. Since an absorption refrigeration unit eliminates the vapor compressor necessary in a mechanical refrigeration unit, power requirements are inherently very low, with only liquid pumping required. Other types of absorption refrigeration units, such as ammonia-water, ammonia-methanol or propane-hexane may also be used.

To demonstrate the advantages of the present invention, material balances and energy requirements were calculated and are provided as the following examples for each of the previously discussed dehydrogenation process liquids recovery sections.

EXAMPLES

Example I

An LPG stream, with isobutane as its primary component, was dehydrogenated according to the process as depicted in FIG. 1. The material balance for the dehydrogenation process with high pressure liquids recovery section is provided in Table I.

Example II

An LPG stream, with isobutane as its primary component, was dehydrogenated according to the process as depicted in FIG. 2. The material balance for the dehydrogenation process with low pressure liquids recovery section is provided in Table II.

Example III

An LPG stream, with isobutane as its primary component, was dehydrogenated according to the process as depicted in FIG. 3. The material balance for the dehydrogenation process with low pressure liquids recovery section utilizing an absorption refrigeration unit is provided in Table III.

In addition to process flow rates, stream temperatures and pressures are detailed in the tables.

TABLE I

Material Balance
High Pressure Recovery
Mechanical Refrigeration Unit Configuration

| | Stream 14 | Stream 26 | Stream 30 | Stream 32 | Stream 46 | Stream 48 | Stream 56 | Stream 58 |
|---|---|---|---|---|---|---|---|---|
| Pressure: psia | 2.1 | 450 | 450 | 450 | 445 | 445 | 440 | 100 |
| Temperature: °F. | 104 | 104 | 104 | 104 | 60 | 60 | 50 | 104 |
| Flow Rate: lb-mols/hr | | | | | | | | |
| $H_2$ | 1767 | 1810 | 43 | 1767 | 2 | 1765 | 2 | 1763 |
| $C_1$–$C_3$ | 340 | 358 | 171 | 187 | 29 | 158 | 26 | 132 |
| $C_4$'s | 2757 | 2807 | 2297 | 510 | 288 | 222 | 218 | 4 |
| Total | 4864 | 4975 | 2511 | 2464 | 319 | 2145 | 246 | 1899 |

TABLE II

Material Balance
Low Pressure Recovery
Mechanical Refrigeration Unit Configuration

| | Stream 14 | Stream 26 | Stream 30 | Stream 32 | Stream 46 | Stream 48 | Stream 56 | Stream 58 |
|---|---|---|---|---|---|---|---|---|
| Pressure: psia | 2.1 | 175 | 175 | 175 | 173 | 173 | 170 | 100 |
| Temperature: °F. | 104 | 104 | 104 | 104 | 45 | 45 | 36 | 94 |
| Flow Rate: lb-mols/hr | | | | | | | | |
| $H_2$ | 1767 | 1775 | 6 | 1769 | 3 | 1766 | 1 | 1765 |
| $C_1$–$C_3$ | 340 | 349 | 47 | 302 | 96 | 206 | 39 | 167 |
| $C_4$'s | 2757 | 2791 | 1079 | 1712 | 1273 | 439 | 433 | 6 |

TABLE II-continued

| Material Balance Low Pressure Recovery Mechanical Refrigeration Unit Configuration | Stream 14 | Stream 26 | Stream 30 | Stream 32 | Stream 46 | Stream 48 | Stream 56 | Stream 58 |
|---|---|---|---|---|---|---|---|---|
| Total | 4864 | 4915 | 1132 | 3783 | 1372 | 2411 | 473 | 1938 |

TABLE III

| Material Balance Low Pressure Recovery Adsorption Refrigeration Unit Configuration | Stream 14 | Stream 26 | Stream 30 | Stream 32 | Steam 46 | Stream 48 | Stream 56 | Stream 58 |
|---|---|---|---|---|---|---|---|---|
| Pressure: psia | 2.1 | 175 | 175 | 175 | 173 | 173 | 170 | 100 |
| Temperature: °F. | 104 | 104 | 104 | 104 | 45 | 45 | 36 | 94 |
| Flow Rate: lb-mols/hr | | | | | | | | |
| $H_2$ | 1767 | 1775 | 6 | 1769 | 3 | 1766 | 1 | 1765 |
| $C_1$-$C_3$ | 340 | 349 | 47 | 302 | 96 | 206 | 39 | 167 |
| $C_4$'s | 2757 | 2791 | 1079 | 1712 | 1273 | 439 | 433 | 6 |
| Total | 4864 | 4915 | 1132 | 3783 | 1372 | 2411 | 473 | 1938 |

| | Stream 104 | Stream 106 |
|---|---|---|
| Pressure: psia | 26 | 26 |
| Temperature: °F. | 242 | 242 |
| Flow Rate: 1000 lbs/hr | | |
| Steam | 23.3 | — |
| Condensate | — | 23.3 |

Energy requirements for each of the liquids recovery processes are shown in Table IV.

TABLE IV

| | Example I | Example II | Example III |
|---|---|---|---|
| Liquids Recover Section Pressure: psia | 450 | 175 | 175 |
| Type of Refrigeration, | | | |
| High Level | Mechanical | Mechanical | Absorption |
| Low Level | None | Mechanical | Mechanical |
| Power Requirements: Hp | | | |
| Compressor 16 | 18,000 | 15,600 | 15,600 |
| Refrig. Unit 40 | 330 | 1,500 | — |
| Refrig. Unit 60 | — | 850 | 850 |
| Refrig. Unit 110 | — | — | 100 |
| Total | 18,330 | 17,950 | 16,550 |
| Power Savings Over Example I | — | 2.1 | 10.8 |
| Power Savings Over Example II | — | — | 8.5 |

In Example I, the reactor product, stream 14, was compressed to 450 psia prior to low temperature processing for $C_4$ liquids recovery. The 450 psia pressure level had been selected because it resulted in an "auto-refrigerated" low temperature recovery section. A very large fraction of the $C_4$ hydrocarbons, about 82%, was thereby condensed above 100° F. using cooling water. A relatively small fraction, about 10%, of the $C_4$ hydrocarbons was condensed in the precooling exchanger, resulting in the low requirement for high level refrigeration, i.e. about 300 tons, requiring an energy input of about 330 HP. The remaining $C_4$ hydrocarbons, about 8%, were recovered in the low temperature recovery unit utilizing refrigeration obtained solely from work expansion of the separated light gases from feed pressure to fuel pressure. The reactor regeneration flue gas was vented from the heat recovery section at 410° F., since recovery of lower level heat is normally uneconomical. The energy requirement of Example I is approximately 18,330 HP.

In Examples II and III the reactor product gas stream 14, is compressed to only 175 psia. As a result a much smaller fraction of the $C_4$ hydrocarbons is condensed, about 39%, in cooling water exchanger 20. Nearly half, about 46%, is now condensed in exchanger 34, which increases the high level refrigeration requirement to about 1300 tons. As can be seen from Example II, this requires approximately 1500 HP when supplied by mechanical refrigeration. The remaining $C_4$ hydrocarbons, about 15%, are recovered in the low temperature recovery unit. This low temperature recovery unit requires about 300 tons, about 850 HP, of additional refrigeration to supplement the refrigeration provided by the expansion of the light gas stream.

Assuming all mechanical refrigeration, as in Example II, the total energy requirement of the low pressure recovery process is approximately 17,950 HP. This is only a 2.1% savings when compared to Example I.

When the high level refrigeration is provided by an absorption refrigeration unit instead of the conventional mechanical means, according to the present invention as illustrated by Example III, the total energy requirement of the low pressure recovery process is reduced to approximately 16,550 HP. This is an 8.5% savings when compared to Example II and a 10.8% savings when compared to Example I. These savings in energy requirements are substantial no matter what the process.

Obviously, the specific embodiment of the invention which has been described is only one example of the application of the invention. The recovery of low level waste heat for the production of absorption refrigeration to be used for the separation and recovery of $C_3$+ hydrocarbons need not be limited to a single process, e.g. dehydrogenation. Low level waste heat may be recovered from any suitable processes to be used in the same manner for $C_3$+ liquids recovery in a second, unrelated process or combination of processes.

The present invention has been described with reference to a preferred embodiment thereof. However, this embodiment should not be considered a limitation on the scope of the invention, which scope should be ascertained by the following claims.

We claim:

1. A process for the separation and recovery of $C_3+$ liquid hydrocarbons from a process product stream having high concentrations of lighter components, which comprises the steps of:

(a) compressing said process product stream to a pressure of about 75 to 250 psia, unless already compressed to a pressure of about 75 to 250 psia;

(b) cooling said compressed product stream thereby condensing a first portion of the $C_3+$ hydrocarbons in the product stream;

(c) separating out the first portion of condensed $C_3+$ hydrocarbons from the product stream;

(d) further cooling the remaining product stream by heat exchange with a circulating refrigerant produced by an absorption refrigeration cycle, said absorption refrigeration cycle utilizing low level recovered heat from the process generating the process product stream, thereby condensing a second and large portion of the $C_3+$ hydrocarbons in the product stream;

(e) separating out the second and large portion of condensed $C_3+$ hydrocarbons from the product stream;

(f) drying the remaining product stream in a drier to remove any impurities which would freeze out in a low temperature recovery unit; and (g) feeding the dried remaining product stream to a low temperature recovery unit thereby cooling the dried remaining product stream, condensing at least a portion of any remaining $C_3+$ hydrocarbons, separating out and removing said portion of said $C_3+$ hydrocarbons, and removing a waste stream consisting essentially of lighter components.

2. The process of claim 1 wherein said low temperature recovery unit is a dephlegmator-type low temperature recovery unit.

3. The process of claim 1 wherein said absorption refrigeration cycle is a lithium bromide-water absorption cycle.

4. The process of claim 1 wherein said absorption refrigeration cycle is an ammonia-water absorption cycle.

5. The process of claim 1 wherein said absorption refrigeration cycle is an ammonia-methanol absorption cycle.

6. The process of claim 1 wherein said absorption refrigeration cycle is a propane-hexane absorption cycle.

7. The process of claim 1 wherein said process product stream is the product of a catalytic cracking process.

8. A process for the separation and recovery of $C_3+$ liquid hydrocarbons from a dehydrogenation process product stream having high concentrations of lighter components, which comprises the steps of:

(a) compressing said process product stream to a pressure of about 75 to 250 psia, unless already compressed to a presure of about 75 to 250 psia;

(b) cooling said compressed product stream thereby condensing a first portion of the $C_3+$ hydrocarbons in the product stream;

(c) separating out the first portion of condensed $C_3+$ hydrocarbons from the product stream;

(d) further cooling the remaining product stream by heat exchange with a circulating refrigerant produced by an absorption refrigeration cycle, said absorption refrigeration cycle utilizing low level recovered heat from the dehydrogenation process, thereby condensing a second and large portion of the $C_3+$ hydrocarbons in the product stream;

(e) separating out the second and large portion of condensed $C_3+$ hydrocarbons from the product stream;

(f) drying the remaining product stream in a drier to remove any impurities which would freeze out in a low temperature recovery unit; and (g) feeding the dried remaining product stream to a low temperature recovery unit thereby cooling the dried remaining product stream, condensing at least a portion of any remaining $C_3+$ hydrocarbons, separating out and removing said portion of said $C_3+$ hydrocarbons, and removing a waste stream consisting essentially of lighter components.

9. The process of claim 8 wherein said low temperature recovery unit is a dephlegmator-type low temperature recovery unit.

10. The process of claim 8 wherein said absorption refrigeration cycle is a lithium bromide-water absorption cycle.

11. The process of claim 8 wherein said absorption refrigeration cycle is an ammonia-water absorption cycle.

12. The process of claim 8 wherein said absorption refrigeration cycle is an ammonia-methanol absorption cycle.

13. The process of claim 8 wherein said absorption refrigeration cycle is a propane-hexane absorption cycle.

* * * * *